United States Patent [19]

Carollo et al.

[11] 4,166,324

[45] Sep. 4, 1979

[54] ILLUMINATED SIGHT

[76] Inventors: Glenn M. Carollo, 2480 He-Nis-Ra La., Green Bay, Wis. 54303; Thomas M. Canadeo, 1023 Bluebird St., DePere, Wis. 54115

[21] Appl. No.: 868,901

[22] Filed: Jan. 12, 1978

[51] Int. Cl.[2] ..... F41G 1/34; F41G 1/46

[52] U.S. Cl. ..... 33/241; 33/265

[58] Field of Search ..... 33/241, 242, 243, 265; 124/87; 42/1 S; 240/2 F, 6.41; 362/110

[56] References Cited

U.S. PATENT DOCUMENTS

| | | | |
|---|---|---|---|
| 802,277 | 10/1905 | Fric | 33/241 |
| 1,931,552 | 10/1933 | Maris | 33/241 |
| 2,911,724 | 11/1959 | Conant | 33/241 |
| 3,362,074 | 1/1968 | Luebkeman et al. | 33/243 |
| 3,678,590 | 7/1972 | Hayward | 33/241 |
| 3,833,799 | 9/1974 | Audet | 33/241 |
| 3,914,873 | 10/1975 | Elliott, Jr. et al. | 33/241 |
| 3,945,127 | 3/1976 | Spencer | 33/241 |

FOREIGN PATENT DOCUMENTS

| | | | |
|---|---|---|---|
| 26060 | of 1896 | United Kingdom | 33/241 |

*Primary Examiner*—Richard R. Stearns

*Attorney, Agent, or Firm*—Dennis J. Verhaagh

[57] ABSTRACT

An illuminated sight is disclosed which comprises a transparent member having light diverting and receiving portions, a light source with means for orienting said light source with respect to the transparent member and means for mounting to an instrument or weapon.

1 Claim, 7 Drawing Figures

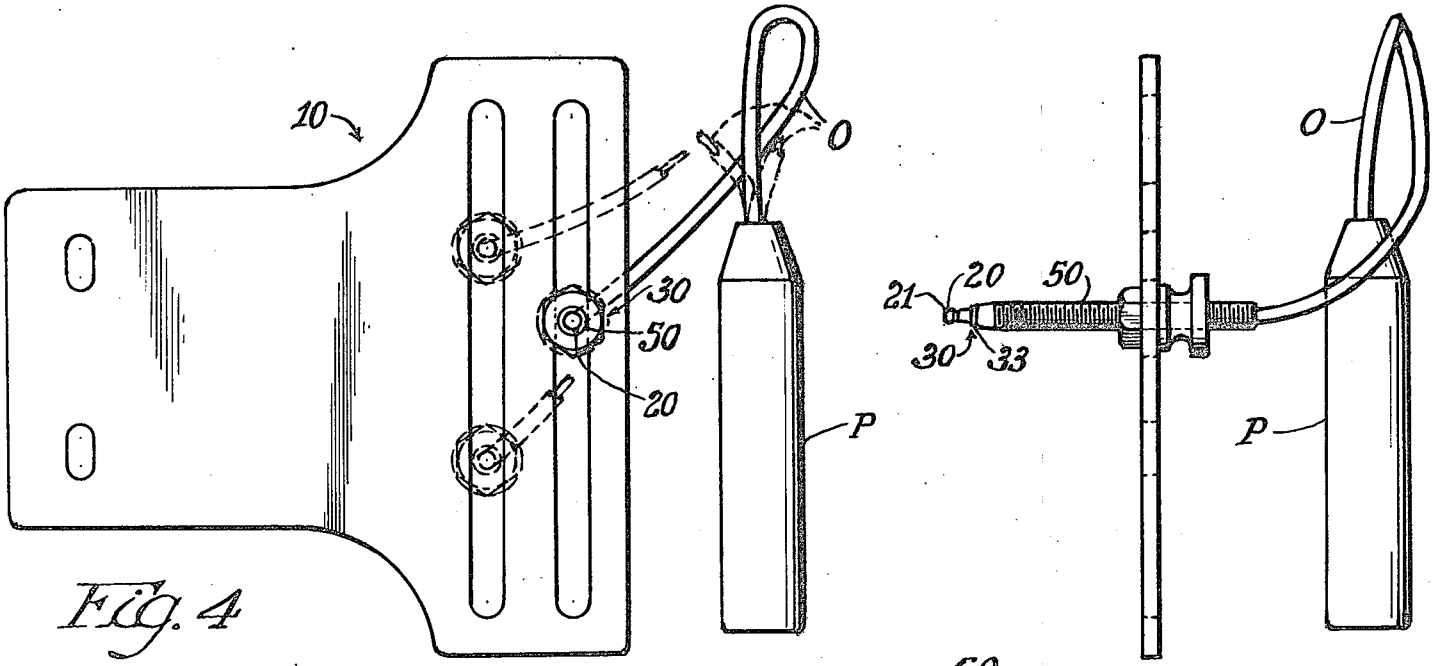
Fig. 5
Fig. 4
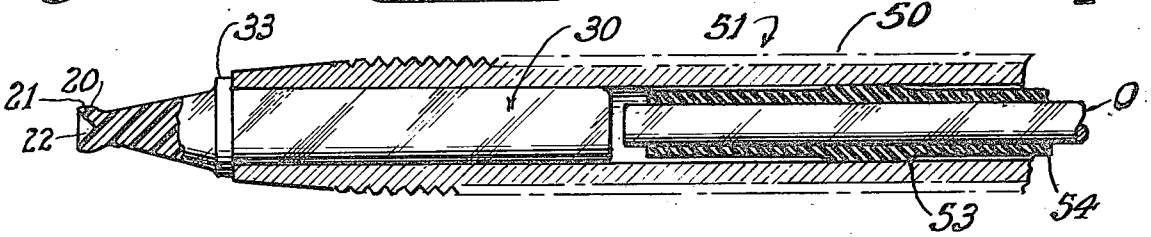
Fig. 6
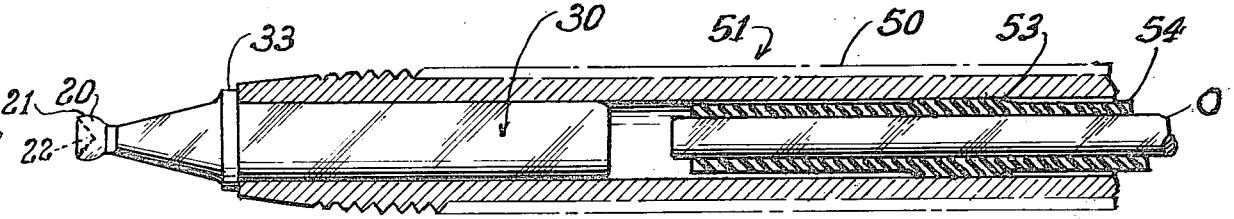
Fig. 7

ILLUMINATED SIGHT

BACKGROUND OF THE INVENTION

This invention relates generally to illuminated sights and more particularly concerns an illuminated sight assembly which can be adjusted in intensity and which provides a distinct sight either lit or unlit.

There are gun sights and bow sights which do employ fiber optics or LEDs (light emitting diodes) to illuminate sights for guns and the like. Both of these methods of illumination have drawbacks which are overcome by this invention. Both the LED and the fiber optics sights employ a bead sight or series of bead sights which are illuminated to form a sight pattern. Existing LED beads have been found to be so large as to obliterate the target. In addition, the electrical connections of LED systems are fragile and are not suitable for rugged usage. Furthermore, LEDs do not have the desirable bead shape which is preferred by target shooters. They have the further disadvantage of giving a different sight pattern when lit.

On the other hand, optical fibers have the disadvantage of being impractical for use as a sight when they are the sole method used. With a system composed entirely of fiber optics, the light for the bead is primarily visible from the end of the fiber. Thus, when used as a sight or indicator, the fiber must be positively positioned to exhibit its end to the viewer. Such sights have been found too delicate for rugged usage. Slight deviations in the end of the fiber result in a loss of illumination to the line of sight of the viewer.

SUMMARY OF THE INVENTION

This invention provides what current illuminated sighting systems cannot provide, a pin point illuminated bead which is mechanically sound and has outstanding physical and optical properties.

This type of sight not only gives the same sight pattern when lit or unlit; but the concentration of light at the center of the tip of bead actually gives a finer optical tip than the physical tip size. This is an asset even in good lighting conditions.

Additionally, this invention enables one to vary the intensity of the sight which can be made to match the existing light condition, thus eliminating what shooters term the "halo" effect of illuminated sights currently in use.

There are other advantages of this invention which can be found in the detailed description, the claims, and the drawings.

BRIEF DESCRIPTION OF THE DRAWINGS

The preferred embodiment and an alternate embodiment of this invention are shown in the drawings.

FIG. 4 is the side view of a bow sight mount showing three sights of the invention mounted thereon.

FIG. 5 is an end view of a bow sight mount showing one sight of the invention mounted thereon.

FIG. 6 is a partially cut away side view of the sight assembly showing adjustment at maximum light intensity.

FIG. 7 is a partially cut away side view of the sight assembly showing adjustment at minimum light intensity.

Figures 1, 2, 3:
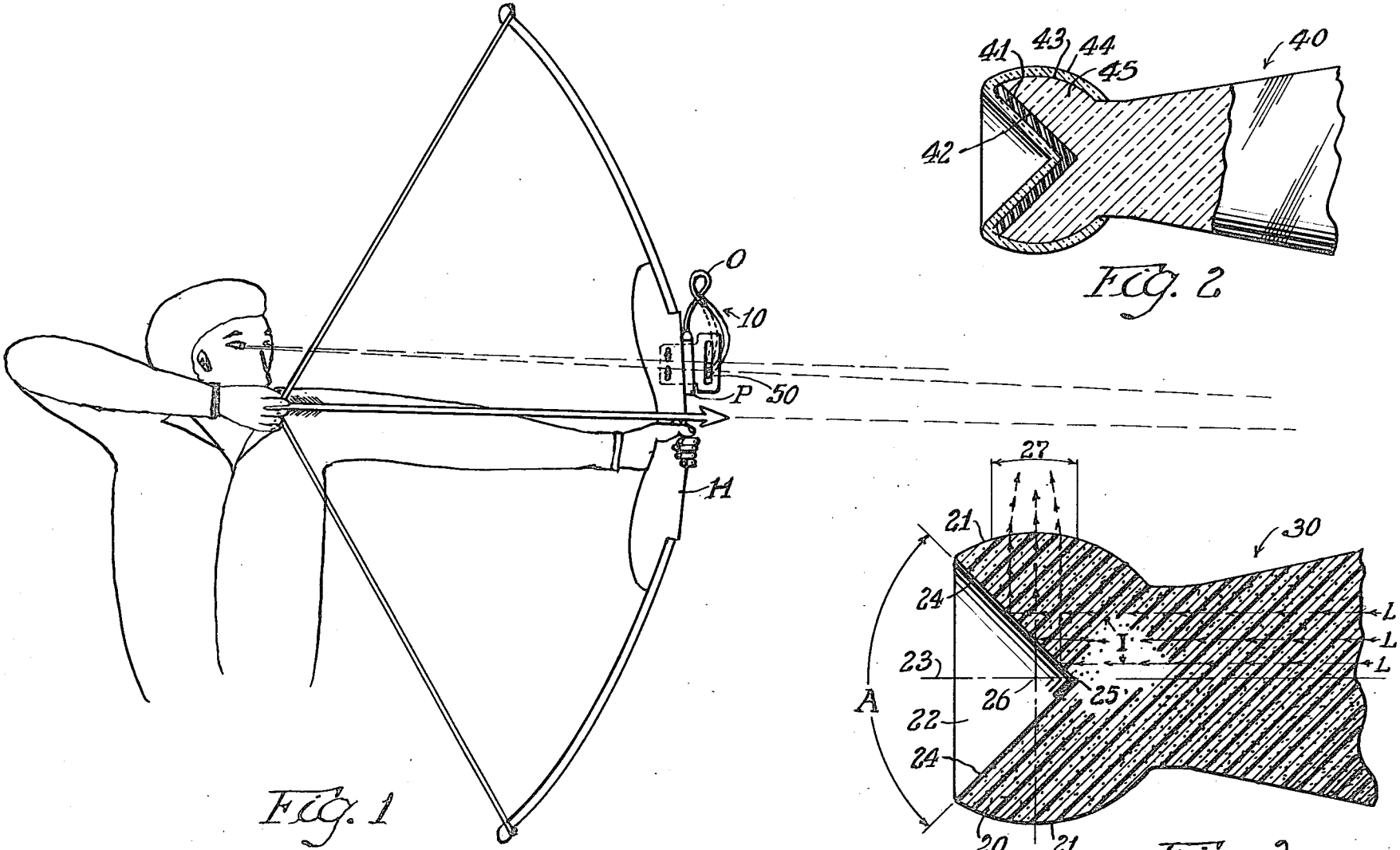
FIG. 1 is a perspective view showing the use of the sight assembly mounted to a bow.
FIG. 2 is a cross sectioned side view of the bead end of the sight body showing one embodiment of the invention.
FIG. 3 is a cross sectioned side view of the bead end of the sight body showing the preferred embodiment of the invention.

The invention is described in connection with a preferred embodiment or form. It is not intended that the invention be limited to that preferred form. On the contrary, it is intended that all alternatives, modifications and equivalents be included.

DESCRIPTION OF THE PREFERRED EMBODIMENT AND AN ALTERNATE EMBODIMENT

Turning first to FIG. 1, the sight assembly 10 is shown used for a bow sight. The sight as shown is mounted to the bow handle H and is adjusted vertically and horizontally depending upon the range to the target. There are many such illuminated sights on the market used with both firearms and bows.

FIG. 2 is a view of an alternative embodiments. FIG. 3 is a view of the preferred embodiment. The sight body 30 is the principal feature of the invention. It is composed of a transparent material with a high light transmission factor. One end 20 is molded or machined to a bead shape. Light enters at the other end of the sight body and is diverted to the bead surface 21. A cone-shaped indentation 22 is molded into the end of the bead. The axis of the cone 23 lies coaxially with the axis of the sight body 30 which is preferably cylindrical. This is the principal feature of the invention. Light L entering the sight body is reflected off the cone 22 and to the surface of the bead 21. Since the angle A of the cone 22 can be precisely molded or machined, the pattern of illumination of the bead can be precisely formed. Though other forms of indentations besides cones can be used, such as spherical shapes, the cone shape is preferred because the resultant light transmissions are easily predictable.

Although many materials with high light transmission properties may be used as the material for the sight body 30, a material found to be ideally suited for use is a polycarbonate such as Lexan, manufactured by General Electric Corporation. Lexan is transparent and has a high refractive index (1.586) at room temperature. Other materials which have been found suitable for the sight body are acrylics such as Plexiglass. However, any transparent material with a favorable light transmission factor can be employed as the sight body.

If the incident light ray L strikes the conical surface 24 at anything other than the perpendicular, it creates an angle of incidence I with the perpendicular. This angle then determines the angle a ray refracted from the sight body makes with the normal. The difference between the sine of the incident angle and the sine of the refracted angle is inversely proportional to the refractive indices of the two environments, e.g., Lexan and air.

$$\frac{\text{sine of incident angle in Lexan}}{\text{sine of refractive index in air}} = \frac{\text{refractive index of air } (1.00)}{\text{refractive index of Lexan}}$$

From the above equation, a maximum refractive angle of 90 degrees will occur when the incident angle I is 39.08 degrees. This angle is known as the critical angle Ic for the material. Incident light rays I greater than the critical angle Ic are reflected off the surface of the cone 24 instead of being transmitted through the cone. This is the purpose of the cone 21 in the invention, i.e., to reflect as much light as possible onto the bead surface 21. From the equation, it can be seen that the higher the refractive index of the bead material, the lower the critical angle becomes. Essentially, this means that incident light rays L can strike the cone at a more direct angle and still be reflected back into the bead 20. It is also apparent that the smaller the cone angle A, the greater the angle of incidence I for any given ray and thus the more light will be reflected. However, as the cone angle A is reduced, the more light is transmitted to the tip of the bead rather than being uniformly distributed. Thus the cone angle is a compromise. As FIG. 3 shows, the apex of the cone 25 preferably does not coincide with the exact center of the sphere of the bead 26. It is preferred for side viewing of the bead that the lighted portion of the bead 27 traverse a band about the center of the bead. In order to have this occur, the cone apex 25 must extend further into the bead as shown. It has been found that positioning the apex 25 at approximately two-thirds of the diameter of the bead 20 has achieved good results. This has been found to be the most preferable cone dimension for light distribution on the bead for side vision.

FIGS. 4 and 5 show the assembly of the preferred embodiment using a standard penlight P with optical fibers O. Present bowsights use similar arrangements on unilluminated sight beads. However, the sight bead of the invention 20 is new. A light source to illuminate the sight bead is shown as a standard penlight P which is available on the market. The penlight P could be oriented immediately behind the sight body 30 providing a direct optical link. However, it is preferable that it be mounted in a position more accessible to the hand of the viewer. In FIG. 1, the mounting position is shown on the handle of a bow H. Since a direct optical link is cumbersome in this arrangement, an optical fiber is provided as shown to make the optical link between the light source and the sight body 30. This provides a much more adaptable assembly which can be fitted to any instrument requiring a sight.

In the preferred embodiment, a commercially available glass embodiment. or the like is added to the transparent material prior to molding of the sight body. This imparts a color to the sight which differentiates it from surrounding environments. The alternate embodiment shown in FIG. 2 has also been found to be effective. A clear transparent sight body 40 is used, devoid of any coloring. A reflective coating 41 is painted on the interior of the cone surface 42. Then, over the reflective coating 41 and the outside bead surface 43, a colored transparent coating 44 is painted. Light transmitted through the sight body 40 is reflected from the reflective surface of the cone 41 and the bead 45 appears as a suspended bead of colored light on side viewing. The coloring gives a bead effect in the daylight when illuminization is unnecessary.

FIG. 3 shows the sight body 30 tapering to a bead 20. One function of the sight body 30 is to provide support for the bead 20 besides transmitting light to it with a minimum of loss. As shown in FIGS. 6 and 7, the sight body 30 is assembled in a tube 50 which is threaded for mounting on a bow. It has been found that standard brass tubing of 3/16 inch outside diameter and 0.090 inch inside diameter makes the best assembly since no machining is requred except for threading the tubing. The sight body 30 is molded to a 0.090 inch outside diameter to accommodate the tubing 50. Since the standard bead in the industry is much less than 0.090 inch (about 0.062 inch), it has been found to be preferable to taper the sight body 30 to limit the transmission losses and to maintain the bead shape 20.

Another feature of the invention lies in the optical linkage between the light source and the sight body 30. It has been found that the light intensity of the bead 20 can be varied by merely adjusting the distance between the fiber optics O and the sight body 30. In practice, present illuminated sights have too bright an illumination for low light conditions. This results in a "halo effect" which obscures the target and sometimes results in night blindness. By varying the distance between the light source and the sight body, the intensity of the sight bead can be lowered to reduce this "halo effect" and adjust the sight illumination for comfortable usage in low light conditions. This feature is shown in FIGS. 6 and 7. The sight body assembly 51 is shown in the two figures. A sight body 30 having a flange 33 as an integral part is inserted flush into the tubular holder 50.

An optical fiber is adjustably inserted immediately behind the sight body 30. A crimp 53 is made in the fiber sheathing 54 as a preferable method of providing a drag on the fiber O so its adjustments can be maintained.

In FIG. 6, the optical fiber O is shown in close proximity to the sight body 30. At this point, light transmission between the fiber and the sight body 30 is at a maximum and the intensity of the light at the bead 20 is at a maximum. In FIG. 7, the optical fiber O is pulled back to lower the intensity of the bead illumination. The user may thus make an infinite number of adjustments to conform to the ambient light conditions and reduce objectionable "halo" effects.

CROFON fiber optics, manufactured by Dupont, with a 0.087 inch outside diameter and a standard brass tubing have been found to be best on a cost basis for this assembly since no machining is required except for threading of the tubing 50 and crimping of the fiber sheathing 54.

This is then the preferred embodiment or form of the invention and an alternate form and the methods of practicing them. Those skilled in the art will see that other forms and applications may be made without departing from the scope of the invention. Therefore, this disclosure and description is merely illustrative and not intended to be limiting in any sense.

What is claimed is:

1. An improved sight assembly comprising:

(a) a light source:

(b) a transparent member having as an integral part thereof a bead portion, said bead portion having surfaces for reflecting light received from said light source and for refracting said reflected light whereby an illuminated sight pattern is formed on said refracting surface;

(c) means for conducting light from the light source to the transparent member; and (d) means for mounting said light source, transparent member and conducting means to an instrument to be sighted.

* * * * *